US012240034B2

(12) United States Patent
Morton

(10) Patent No.: US 12,240,034 B2
(45) Date of Patent: Mar. 4, 2025

(54) WIRE STRAIGHTENING SOLUTION FOR BULK PACKAGING

(71) Applicant: Lincoln Global, Inc., Santa Fe Springs, CA (US)

(72) Inventor: Sean D. Morton, Grand Valley (CA)

(73) Assignee: LINCOLN GLOBAL, INC., Santa Fe Springs, CA (US)

( * ) Notice: Subject to any disclaimer, the term of this patent is extended or adjusted under 35 U.S.C. 154(b) by 570 days.

(21) Appl. No.: 17/567,216

(22) Filed: Jan. 3, 2022

(65) Prior Publication Data

US 2023/0211404 A1 Jul. 6, 2023

(51) Int. Cl.

| | |
|---|---|
| ***B21F 1/02*** | (2006.01) |
| ***B21C 47/18*** | (2006.01) |
| ***B21C 47/22*** | (2006.01) |
| ***B21D 3/02*** | (2006.01) |
| ***B21D 3/06*** | (2006.01) |
| ***B23K 37/00*** | (2006.01) |
| ***B65H 49/08*** | (2006.01) |
| ***B65H 57/14*** | (2006.01) |

(52) U.S. Cl.

CPC ..... *B21F 1/023* (2013.01); *B21D 3/02* (2013.01); *B65H 2701/36* (2013.01)

(58) Field of Classification Search

CPC ... B21F 1/023; B21F 1/02; B21D 3/02; B21D 3/06; B65H 2701/36; B65H 49/08; B65H 57/14; B21C 47/22; B21C 47/18; B23K 37/00

See application file for complete search history.

(56) References Cited

U.S. PATENT DOCUMENTS

| | | | | |
|---|---|---|---|---|
| 1,847,454 | A | 3/1932 | Webb | |
| 3,595,277 | A | 7/1971 | Lefever | |
| 8,689,975 | B2 | 4/2014 | Burke | |
| 2013/0168479 | A1* | 7/2013 | Cooper | B65H 57/14 242/157 R |
| 2016/0354820 | A1* | 12/2016 | Katou | B21F 1/02 |
| 2021/0220938 | A1* | 7/2021 | Gelmetti | B23K 37/00 |

FOREIGN PATENT DOCUMENTS

| | | | |
|---|---|---|---|
| EP | 0 620 058 | A1 | 10/1994 |
| WO | 93/13892 | A1 | 7/1993 |
| WO | 96/22166 | A1 | 7/1996 |
| WO | 99/46066 | A1 | 9/1999 |

* cited by examiner

*Primary Examiner* — Mohammed S. Alawadi

(74) *Attorney, Agent, or Firm* — David J. Muzilla

(57) ABSTRACT

A configuration and method for straightening a wire as the wire pays off from a bulk package. A bulk package hat is configured to be positioned over an opened bulk package containing wire bent in a helix shape. A bearing assembly is mounted inside the bulk package hat at a position where the wire exits the bulk package hat as the wire pays off from the bulk package. A wire straightening device has a plurality of rollers and only one single plane of straightening, and is configured to apply a counter bend to the wire as the wire pays off from the bulk package through the wire straightening device. The wire straightening device is operatively connected to the bearing assembly at an angle inside the bulk package hat. The bearing assembly and the single plane of straightening rotate, continually realigning with a current direction of the wire as it pays off.

20 Claims, 5 Drawing Sheets

WIRE STRAIGHTENING SOLUTION FOR BULK PACKAGING

REFERENCE

U.S. Pat. No. 3,595,277, issued on Jul. 27, 1971, is incorporated herein by reference in its entirety. U.S. Pat. No. 8,689,975, issued on Apr. 8, 2014, is incorporated herein by reference in its entirety.

FIELD

Embodiments of the present invention relate to straightening a wire. More specifically, embodiments of the present invention relate to straightening a wire (e.g., a consumable welding wire) as the wire pays off from a bulk package, where the wire is bent (e.g., bent in a helix shape) within the bulk package.

BACKGROUND

Wire in bulk packaging is bent, for example, in a helix shape, due to the nature of the packaging process. In order to straighten the helix, the wire is typically run through two wire straighteners positioned at 90 degrees to each other to provide straightening in two planes. However, the use of wire straighteners causes drag on the wire, increasing the generation of detrimental shavings in the wire conduits and wear in the wire feeding system. It is desirable to reduce the drag on the wire by using other means.

SUMMARY

Embodiments of the present invention are concerned with assemblies and methods for straightening a wire (e.g., a consumable welding wire) as the wire pays off from a bulk package. A bulk package hat is configured to be positioned over a bulk package containing wire bent in a helix shape. A bearing assembly is mounted inside the bulk package hat at a position where the wire exits the bulk package hat as the wire pays off from the bulk package. A wire straightening device has a plurality of rollers and only one single plane of straightening. The wire straightening device is configured to apply a counter bend to the wire in only the one single plane of straightening as the wire pays off from the bulk package through the wire straightening device. The wire straightening device is operatively connected to the bearing assembly at an angle inside the bulk package hat. The bearing assembly is configured to rotate in response to the wire paying off from the bulk package through the wire straightening device. The wire straightening device stays at the angle such that the single plane of straightening continues to substantially realign with a current direction toward a portion of the wire currently paying off from the bulk package as the current direction changes.

In one embodiment, a wire straightening configuration for straightening a wire as the wire pays off from a bulk package is provided. The configuration includes a bulk package hat configured to be positioned over an opened bulk package containing wire bent in a helix shape. A bearing assembly is mounted inside the bulk package hat at a position where the wire exits the bulk package hat as the wire pays off from the bulk package. The configuration also includes a wire straightening device having multiple rollers and only one single plane of straightening. The wire straightening device is configured to apply a counter bend to the wire in only the one single plane of straightening as the wire pays off from the bulk package through the wire straightening device. The wire straightening device is operatively connected to the bearing assembly at an angle inside the bulk package hat. Rotation of the bearing assembly is effected by the wire paying off from the bulk package through the wire straightening device. The bearing assembly is configured to rotate in response to the wire paying off from the bulk package through the wire straightening device, while keeping the wire straightening device at the angle such that the single plane of straightening continues to substantially realign with a current direction toward a portion of the wire currently paying off from the bulk package as the current direction changes. The one single plane of straightening rotates with the wire in response to the wire paying off from the bulk package, allowing for the helix shape to be straightened by the wire straightening device. In one embodiment, the wire straightening device has a longitudinal axis therethrough. The bearing assembly is aligned along a vertical axis of the configuration, and the angle is formed between the vertical axis and the longitudinal axis. The angle between the vertical axis and the longitudinal axis may be, for example, between 5 degrees and 30 degrees, between 1 degree and 10 degrees, or between 15 degrees and 45 degrees, in accordance with various embodiments. The number of multiple rollers in the wire straightening device may be, for example, three roller, five rollers, or seven rollers, in accordance with various embodiments.

In one embodiment, a method for straightening a wire as the wire pays off from a bulk package is provided. The method includes positioning a bulk package hat over an opened bulk package containing wire bent in a helix shape, and mounting a bearing assembly inside the bulk package hat at a position where the wire exits the bulk package hat as the wire pays off from the bulk package. The method also includes operatively connecting a wire straightening device to the bearing assembly at an angle inside the bulk package hat, where the wire straightening device has only one single plane of straightening. The method further includes feeding a distal portion of the wire through the wire straightening device to apply a counter bend to the wire in the one single plane of straightening as the wire pays off from the bulk package through the wire straightening device. The method also includes paying off the wire, and the bearing assembly rotating in response to the wire paying off from the bulk package through the wire straightening device, while keeping the wire straightening device at the angle such that the single plane of straightening continues to substantially realign with a current direction toward a portion of the wire currently paying off from the bulk package as the current direction changes. In one embodiment, the method includes aligning the bearing assembly along a vertical axis of the configuration as part of the mounting, and forming the angle between the vertical axis and a longitudinal axis of the wire straightening device as part of the connecting. The rotation of the bearing assembly is effected by paying off the wire from the bulk package through the wire straightening device. The method further includes the one single plane of straightening rotating with the wire in response to the wire paying off from the bulk package, allowing for the helix shape to be straightened by the wire straightening device. The method may include setting the angle between the vertical axis and the longitudinal axis, for example, between 5 degrees and 30 degrees, between 1 degree and 10 degrees, or between 15 degrees and 45 degrees, in accordance with various embodiments. As part of feeding the wire, the distal portion of the wire is guided through three, five, or seven rollers of the wire straightening device, in accordance with various embodiments.

Numerous aspects of the general inventive concepts will become readily apparent from the following detailed description of exemplary embodiments, from the claims, and from the accompanying drawings.

BRIEF DESCRIPTION OF THE DRAWINGS

The accompanying drawings, which are incorporated in and constitute a part of the specification, illustrate various embodiments of the disclosure. It will be appreciated that the illustrated element boundaries (e.g., boxes, groups of boxes, or other shapes) in the figures represent one embodiment of boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Embodiments of the present invention are concerned with assemblies and methods for straightening a wire (i.e., removing a bent shape such as a helix shape from the wire) as the wire (e.g., a consumable welding wire) pays off from a bulk package (e.g., a cardboard structured bulk package). A bulk package hat is configured to be positioned over an opened bulk package containing wire bent in, for example, a helix shape (however, other shapes may be possible as well). A bearing assembly is mounted inside the bulk package hat at a position where the wire exits the bulk package hat as the wire pays off from the bulk package. A wire straightening device has a plurality of rollers and only one single plane of straightening, and is configured to apply a counter bend to the wire as the wire pays off from the bulk package through the wire straightening device. The wire straightening device is operatively connected to the bearing assembly at an angle inside the bulk package hat. The bearing assembly rotates in response to the wire paying off from the bulk package through the wire straightening device. That is, the rotation of the bearing assembly is effected by the wire paying off from the bulk package through the wire straightening device, while keeping the wire straightening device at the angle such that the single plane of straightening continues to substantially realign with a current direction toward a portion of the wire currently paying off from the bulk package as the current direction changes.

Figure 1:
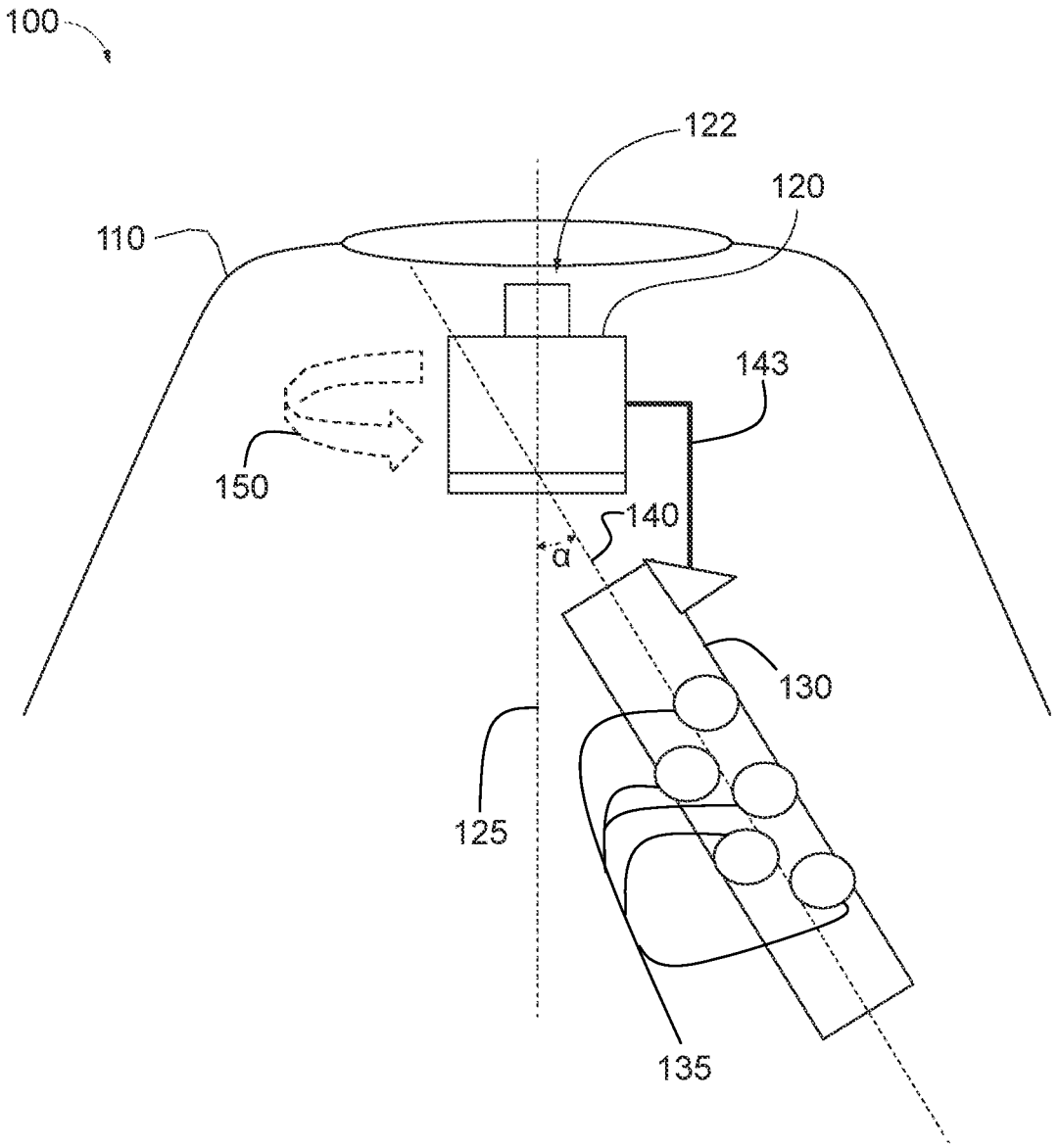
FIG. 1 illustrates a schematic diagram of one embodiment of a wire straightening configuration for straightening a wire as the wire pays off from a bulk package.
Figure 2:
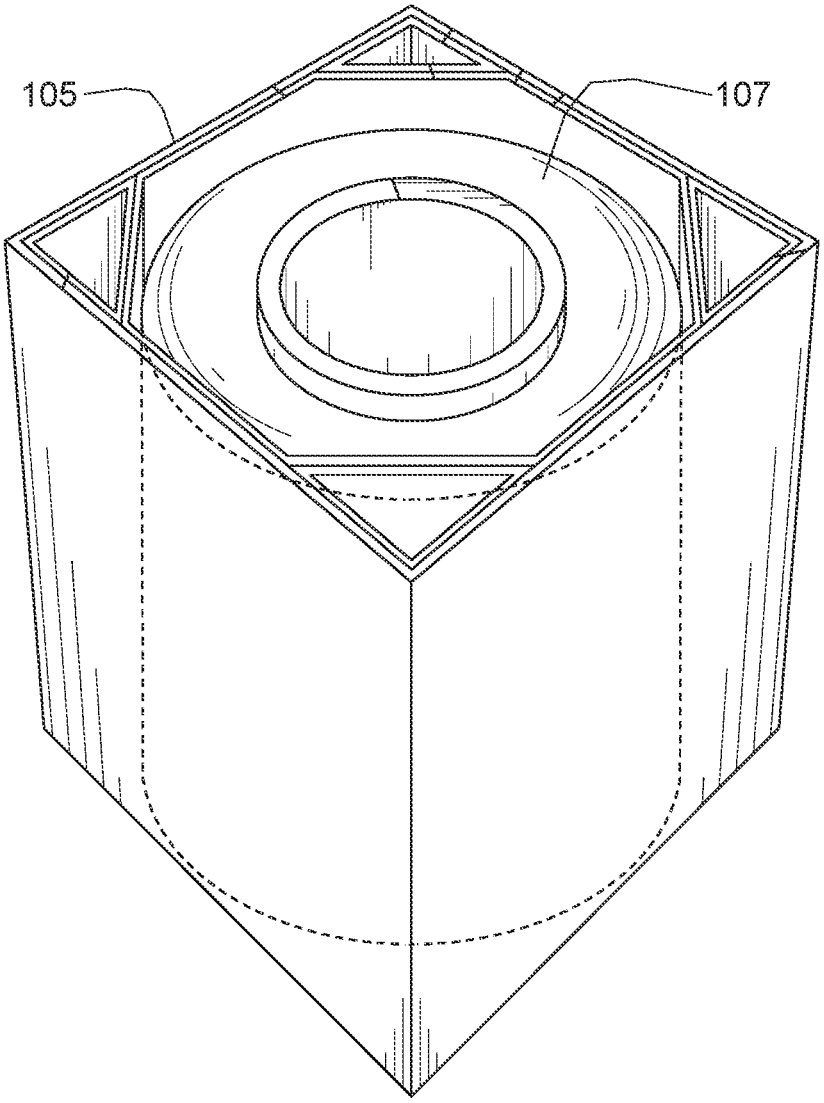
FIG. 2 illustrates one embodiment of an opened bulk package.
Figure 3:
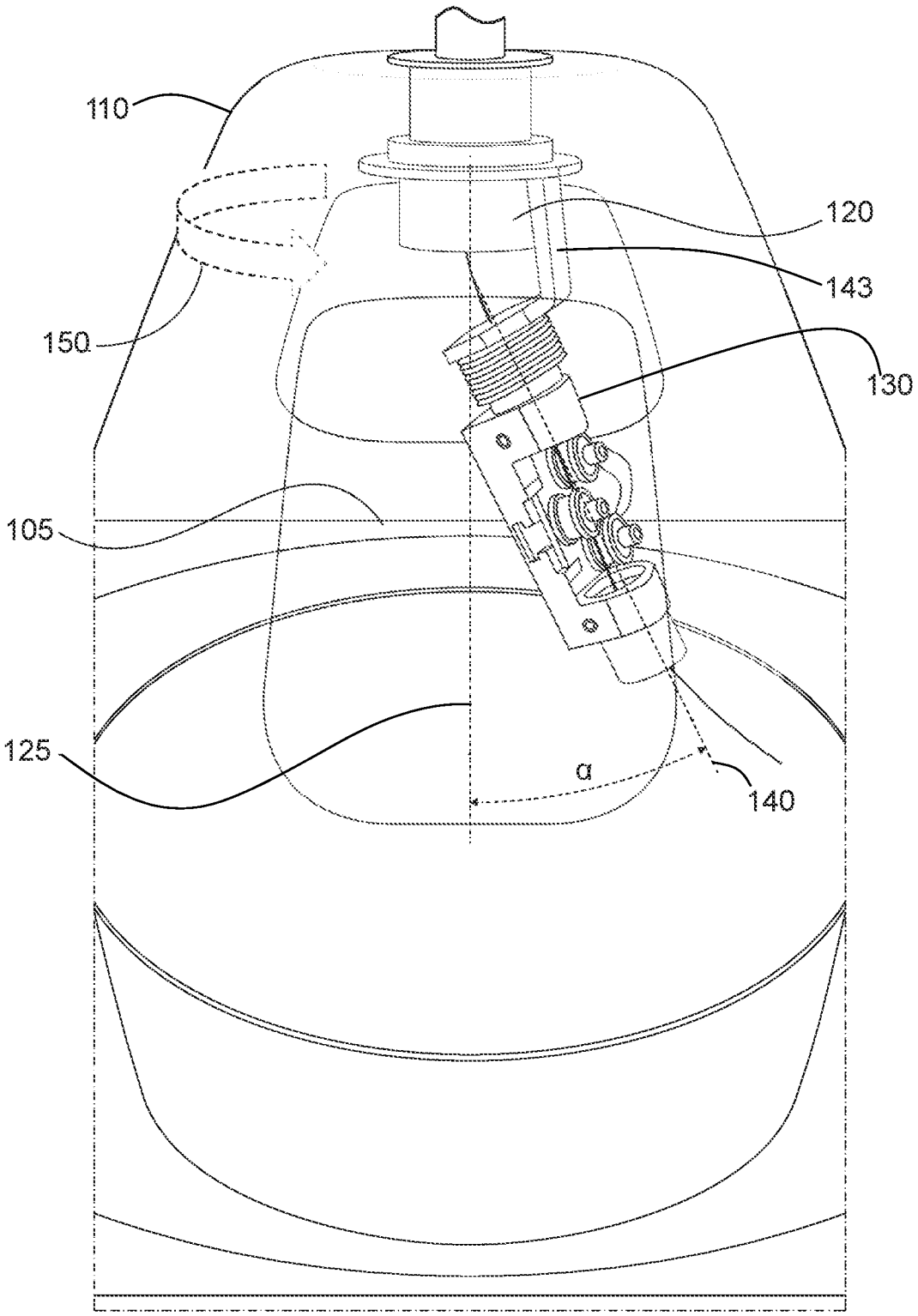
FIG. 3 illustrates one embodiment of a wire straightening configuration as installed above a bulk package containing consumable welding wire bent in a helix shape.
Figure 4:
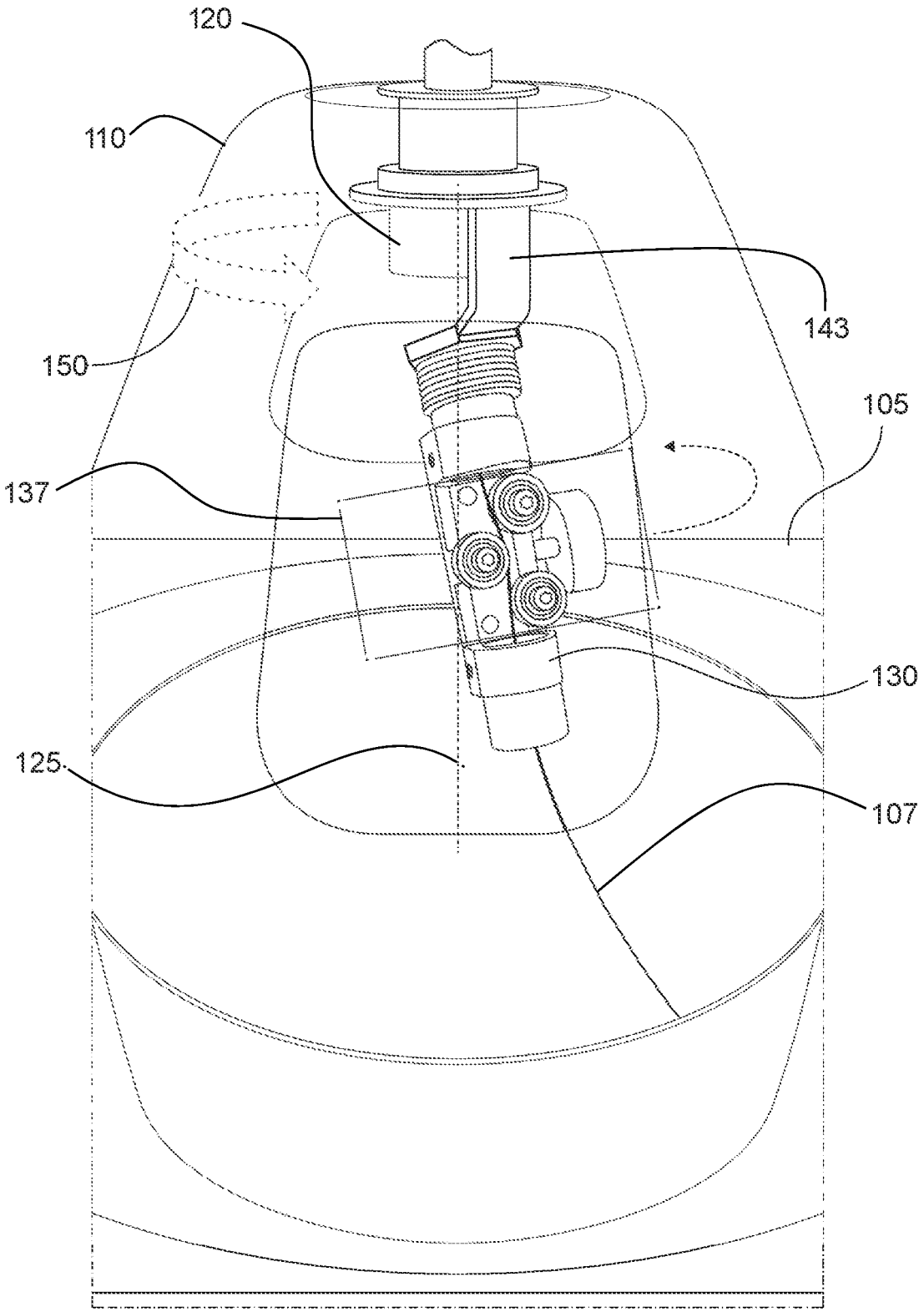
FIG. 4 illustrates the embodiment of FIG. 3, showing a plane of straightening through a wire straightening device of the wire straightening configuration.

The examples and figures herein are illustrative only and are not meant to limit the subject invention, which is measured by the scope and spirit of the claims. Referring now to the drawings, wherein the showings are for the purpose of illustrating exemplary embodiments of the subject invention only and not for the purpose of limiting same, FIG. 1 illustrates a schematic diagram of one embodiment of a wire straightening configuration 100 for straightening a wire as the wire pays off from a bulk package. FIG. 2 illustrates one embodiment of an opened bulk package 105, for example (i.e., a bulk package with its lid or cover removed) containing coiled consumable welding wire 107. FIG. 3 illustrates one embodiment of a wire straightening configuration 100 as installed above a bulk package 105 containing the consumable welding wire 107 bent in a helix shape. FIG. 4 illustrates the embodiment of FIG. 3, showing a plane of straightening 137 through a wire straightening device 130 of the wire straightening configuration 100.

The wire straightening configuration 100 includes a bulk package hat 110 configured to be positioned over the opened bulk package 105 (e.g. see FIG. 1, FIG. 3 and FIG. 4) containing a coiled wire 107 (e.g., see FIG. 2 and FIG. 4) bent in a helix shape. That is, the wire 107 has been stored into the bulk package 105 by coiling the wire 107 into the bulk package 105 such that the wire 107 takes on a helix shape. The bulk package hat 110 is somewhat conically shaped, in accordance with one embodiment, and is made of a transparent plastic material. Other types of hats (having other shapes and being made of other materials) are possible as well, in accordance with other embodiments. The wire straightening configuration 100 also includes a bearing assembly 120 mounted inside the bulk package hat 110 at a position 122 where the wire 107 exits the bulk package hat 110 through the bearing assembly 120 as the wire 107 is payed off from the bulk package 105 during operation. Paying off of the wire 107 may be facilitated by a wire feeder device (not shown) and/or a welding gun (not shown), as is well known in the art.

The wire straightening configuration 100 further includes a wire straightening device 130 having multiple rollers 135 (e.g., three, five, or seven rollers) and only one single plane of straightening 137 (e.g., see FIG. 4). The wire straightening device 130 is configured to apply a counter bend to the wire 107 (via the rollers 135) in only the one single plane of straightening 137 (e.g., see FIG. 4) as the wire 107 pays off from the bulk package 105 through the wire straightening device 130. That is, the rollers 135 apply counter bending forces to the wire 107. The one single plane of straightening 137 rotates with the wire 107 in response to the wire 107 paying off from the bulk package 105, allowing for the helix shape to be straightened by the wire straightening device 130. In general, during operation, the wire 107 is pulled from the bulk package 105 through the wire straightening device 130, through the bearing assembly 120, and out through the top of the bulk package hat 110 as it is payed off.

The wire straightening device 130 is operatively connected to the bearing assembly 120 (e.g., via a bracket 143, in one embodiment) at an angle $\alpha$ within the bulk package hat 110. The angle $\alpha$ is between a central vertical axis 125 through the configuration 100 and a longitudinal axis 140 of the wire straightening device 130, as shown in FIG. 1, in accordance with one embodiment. The bracket 143 may be made of, for example, metal, plastic, and/or ceramic materials. Other types of materials are possible as well. Means for connecting the wire straightening device 130 to the bearing assembly 120, other than a bracket 143, are possible as well, in accordance with other embodiments (e.g., a bolt, a screw, a strap, a magnet). The bearing assembly 120 is configured to rotate around the vertical axis 125 (e.g., in a direction of rotation 150) in response to the wire 107 paying off from the bulk package 105 through the wire straightening device 130. That is, the motion of the wire 107 moving through the configuration 100 as it pays off effects the rotation, in part because of how the wire 107 is stored in the bulk package 105 in the helix shape.

The wire straightening device 130 is maintained at the angle α such that the single plane of straightening 137 (e.g., see FIG. 4) continues to substantially realign with a current direction toward a portion of the wire 107 currently paying off from the bulk package 105 as the current direction changes due to the rotation. That is, the wire straightening device 130 also rotates as the bearing assembly 120 rotates, since the wire straightening device 130 is connected to the bearing assembly 120 at the angle α. In some embodiments, the angle α is between 5 degrees and 30 degrees. In other embodiments, the angle α is between 1 degree and 10 degrees. In still other embodiments, the angle α is between 15 degree and 45 degrees. The value of the angle α may be chosen, for example, based on the diameter or width of the bulk package 105, in accordance with one embodiment. That is, the further the stored wire 107 is from the vertical axis 125, the larger the value of the angle α may be set. In accordance with one embodiment, the angle α is adjustable via an adjustable joint (not shown) in the bracket 143.

In accordance with one embodiment, the wire straightening device 130 is configured to be rotated around its longitudinal axis 140 to a more optimal position during set up, before operation. This amounts to placing the single plane of straightening 137 in a more optimal position. For example, a set key configuration (not shown) may be used to loosen the wire straightening device 130 such that it can be rotated around its longitudinal axis 140. Once a more optimal position is reached via the rotation, the set key configuration can be used to re-tighten the wire straightening device 130 to stay fixed in the more optimal position of rotation with respect to its longitudinal axis 140. The set key configuration may include, for example, an L-wrench and a screw, in accordance with one embodiment. In theory, rotating the wire straightening device 130 (and the single plane of straightening 137) to the more optimal position ensures that the vast majority (if not all) of the helix will be eliminated from the wire during operation. The more optimal position of rotation may be different for different embodiments of the wire straightening configuration 100 and the bulk package 105, depending on, for example, the angle α and/or the size of the bulk package 105.

Figure 5:
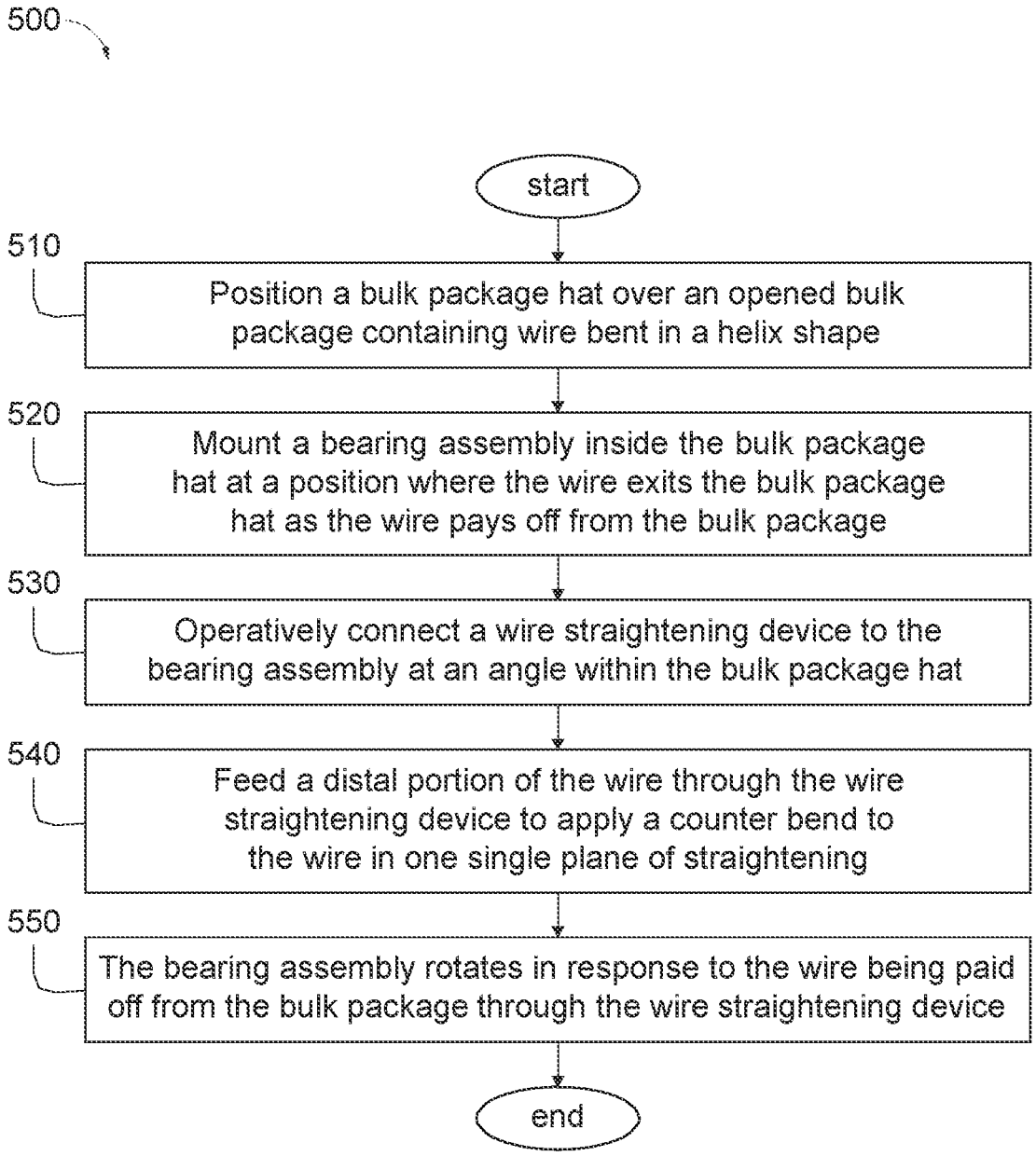
FIG. 5 illustrates a flow chart of one embodiment of a method for straightening a wire as the wire pays off from a bulk package.

FIG. 5 illustrates a flow chart of one embodiment of a method 500 for straightening a wire as the wire pays off from a bulk package. In block 510 of the method 500, a bulk package hat is positioned over an opened bulk package containing wire bent in a helix shape. In block 520, a bearing assembly is mounted inside the bulk package hat at a position where the wire exits the bulk package hat as the wire pays off from the bulk package. The bearing assembly is aligned along a vertical axis of the configuration as part of mounting the bearing assembly, in accordance with one embodiment.

At block 530, a wire straightening device is operatively connected to the bearing assembly at an angle within the bulk package hat, where the wire straightening device has only one single plane of straightening. The angle is formed between the vertical axis and a longitudinal axis of the wire straightening device as part of connecting the wire straightening device, in accordance with one embodiment. As part of connecting the wire straightening device to the bearing assembly, in some embodiments, a value of the angle α is set between 5 degrees and 30 degrees. In other embodiments, a value of the angle α is set between 1 degree and 10 degrees. In still other embodiments, a value of the angle α is set between 15 degree and 45 degrees.

At block 540, a distal portion of the wire is fed through the wire straightening device to apply a counter bend to the wire in the one single plane of straightening when the wire pays off from the bulk package through the wire straightening device. Rotation of the bearing assembly is effected by paying off the wire from the bulk package through the wire straightening device. In accordance with one embodiment, as part of feeding the wire, the distal portion of the wire is guided through rollers (e.g., three, five, or seven rollers) of the wire straightening device. The rollers apply counter bending forces to the wire.

At block 550, the wire is payed off from the bulk package through the wire straightening device, and the bearing assembly rotates in response to the wire paying off from the bulk package through the wire straightening device, while keeping the wire straightening device at the angle such that the single plane of straightening continues to substantially realign with a current direction toward a portion of the wire currently paying off from the bulk package as the current direction changes. That is, the one single plane of straightening of the wire straightening device rotates with the wire in response to the wire paying off from the bulk package, allowing for the helix shape to be straightened (removed) by the wire straightening device.

While the disclosed embodiments have been illustrated and described in considerable detail, it is not the intention to restrict or in any way limit the scope of the appended claims to such detail. It is, of course, not possible to describe every conceivable combination of components or methodologies for purposes of describing the various aspects of the subject matter. Therefore, the disclosure is not limited to the specific details or illustrative examples shown and described. Thus, this disclosure is intended to embrace alterations, modifications, and variations that fall within the scope of the appended claims, which satisfy the statutory subject matter requirements of 35 U.S.C. § 101. The above description of specific embodiments has been given by way of example. From the disclosure given, those skilled in the art will not only understand the general inventive concepts and attendant advantages, but will also find apparent various changes and modifications to the structures and methods disclosed. It is sought, therefore, to cover all such changes and modifications as fall within the spirit and scope of the general inventive concepts, as defined by the appended claims, and equivalents thereof.

What is claimed is:

1. A wire straightening configuration comprising:

a bulk package hat configured to be positioned over an opened bulk package containing a wire;

a bearing assembly mounted inside the bulk package hat at a position where the wire exits the bulk package hat; and a wire straightening device having a plurality of rollers and only one single plane of straightening, wherein the wire straightening device is configured to apply a counter bend to the wire in the only one single plane of straightening as the wire pays off from the bulk package through the wire straightening device, wherein the wire straightening device is operatively connected to the bearing assembly at an angle within the bulk package hat, and wherein the bearing assembly is configured to rotate in response to the wire paying off from the bulk package through the wire straightening device, while keeping the wire straightening device at the angle as the bearing assembly is rotated.

2. The wire straightening configuration of claim 1, wherein the wire straightening device has a longitudinal axis therethrough, and wherein the bearing assembly is aligned along a vertical axis of the configuration, and wherein the angle is formed between the vertical axis and the longitudinal axis.

3. The wire straightening configuration of claim 1, wherein the rotation of the bearing assembly is effected by the wire paying off from the bulk package through the wire straightening device.

4. The wire straightening configuration of claim 1, wherein the only one single plane of straightening rotates with the wire in response to the wire paying off from the bulk package.

5. The wire straightening configuration of claim 1, wherein the angle is between 5 degrees and 30 degrees.

6. The wire straightening configuration of claim 1, wherein the angle is between 1 degree and 10 degrees.

7. The wire straightening configuration of claim 1, wherein the angle is between 15 degrees and 45 degrees.

8. The wire straightening configuration of claim 1, wherein the plurality of rollers includes three rollers.

9. The wire straightening configuration of claim 1, wherein the plurality of rollers includes five rollers.

10. The wire straightening configuration of claim 1, wherein the plurality of rollers includes seven rollers.

11. A method for straightening a wire comprising:

positioning a bulk package hat over an opened bulk package containing wire;

mounting a bearing assembly inside the bulk package hat at a position where the wire exits the bulk package hat;

operatively connecting a wire straightening device to the bearing assembly at an angle within the bulk package hat, wherein the wire straightening device has only one single plane of straightening;

feeding a distal portion of the wire through the wire straightening device to apply a counter bend to the wire in the only one single plane of straightening; and paying off the wire such that the bearing assembly rotates in response to the wire being paid off, while keeping the wire straightening device at the angle as the bearing assembly rotates.

12. The method of claim 11, further comprising aligning the bearing assembly along a vertical axis of the configuration as part of the mounting, and forming the angle between the vertical axis and a longitudinal axis of the wire straightening device as part of the connecting.

13. The method of claim 11, further comprising effecting a rotation of the bearing assembly by paying off the wire from the bulk package through the wire straightening device.

14. The method of claim 11, further comprising the only one single plane of straightening rotating with the wire in response to the wire paying off from the bulk package, allowing for the helix shape to be straightened by the wire straightening device.

15. The method of claim 11, further comprising setting the angle between 5 degrees and 30 degrees as part of the connecting.

16. The method of claim 11, further comprising setting the angle between 1 degree and 10 degrees as part of the connecting.

17. The method of claim 11, further comprising setting the angle between 15 degrees and 45 degrees as part of the connecting.

18. The method of claim 11, further comprising guiding the distal portion of the wire through three rollers of the wire straightening device as part of the feeding.

19. The method of claim 11, further comprising guiding the distal portion of the wire through five rollers of the wire straightening device as part of the feeding.

20. The method of claim 11, further comprising guiding the distal portion of the wire through seven rollers of the wire straightening device as part of the feeding.

* * * * *